US005471929A

United States Patent [19]

Rogge et al.

[11] Patent Number: 5,471,929

[45] Date of Patent: Dec. 5, 1995

[54] APPARATUS FOR THE DISPLACEMENT OF BEARING BLOCKS MOUNTED ON CARRIAGES AND WHICH SUPPORT SHAFTS

[75] Inventors: Günter Rogge, Lienen; Uwe Rogge, Lengerich, both of Germany

[73] Assignee: Windmöller & Hölscher, Lengerich/Westf., Germany

[21] Appl. No.: 208,630

[22] Filed: Mar. 11, 1994

[30] Foreign Application Priority Data

Mar. 18, 1993 [DE] Germany ..... 43 08 711.6

[51] Int. Cl.[6] ..... B41F 13/24

[52] U.S. Cl. ..... 101/247; 101/352; 101/140; 101/182

[58] Field of Search ..... 101/139, 140, 101/144, 145, 152, 153, 182, 184, 185, 209, 247, 351, 352, 283, 284, 285

[56] References Cited

U.S. PATENT DOCUMENTS

| | | | |
|---|---|---|---|
| 3,604,350 | 9/1971 | Rosenstadt | 101/247 X |
| 3,635,160 | 1/1972 | Specht et al. | 101/247 |
| 3,792,658 | 2/1974 | Shore et al. | 101/247 |
| 4,413,560 | 11/1983 | Rogge | 101/247 |
| 4,602,562 | 7/1986 | Ottenhues et al. | 101/182 |
| 4,852,515 | 8/1989 | Terasaka et al. | 101/351 X |
| 4,896,600 | 1/1990 | Rogge et al. | 101/182 |
| 5,099,760 | 3/1992 | Schneider | 101/351 |
| 5,125,339 | 6/1992 | Rogge | 101/247 |
| 5,341,739 | 8/1994 | Rogge et al. | 101/247 |

FOREIGN PATENT DOCUMENTS

| | | | |
|---|---|---|---|
| 0226554 | 6/1987 | European Pat. Off. | 101/247 |
| 0224235 | 6/1987 | European Pat. Off. | 101/247 |
| 9209455 | 1/1993 | Germany . | |
| 2267869 | 5/1993 | United Kingdom . | |

*Primary Examiner*—Chris A. Bennett
*Attorney, Agent, or Firm*—Keck, Mahin & Cate

[57] ABSTRACT

In an apparatus for the displacement of bearing blocks mounted on carriages which support shafts, a first carriage is carried for displacement in a carriage guideway fixed to the frame, and the other carriage is carried in a carriage guideway of the first carriage, these two carriage guideways being mutually parallel. To allow the carriages to be displaced with sufficient accuracy without expensive control devices, two spindle screw nuts designed as toothed belt pulleys are mounted in the first carriage parallel to each other and freely rotatable, and the screw spindles screwed into them are mounted selectively for free rotation and for being fixed, on the one hand in the machine frame and, on the other hand, in the second carriage. In the first carriage there is mounted a further drive belt pulley that is drivable by a motor and securable by a securing device, this further drive belt pulley driving an endless toothed belt that drives said spindle screw nuts designed as toothed belt pulleys.

5 Claims, 1 Drawing Sheet

APPARATUS FOR THE DISPLACEMENT OF BEARING BLOCKS MOUNTED ON CARRIAGES AND WHICH SUPPORT SHAFTS

FIELD OF THE INVENTION

The invention relates to an apparatus for the displacement of shaft-supporting bearing blocks mounted on carriages of which a first carriage is carried for displacement in a carriage guideway fixed to the frame and a second carriage is carried in a carriage guideway of the first carriage, which is parallel to the carriage guideway fixed to the frame, preferably for the displacement of the bearing blocks of plate cylinders and inking rollers of a printing unit in a multicolour rotary printing press. Two screw spindle drives provided with motors displace the carriages.

PRIOR ART

Flexographic printing presses with carriage guideways for the plate cylinders and inking rollers of the above mentioned kind are known for example, from the DE-A-29 41 521, DE-A-34 37 216, DE-A-37 42 129 and DE-A-40 01 735.

In an apparatus known from DE-GM 92 09 455 for the displacement of carriages carrying plate cylinders and inking rollers, both carriages are carried in a common carriage guideway of the frame of the flexographic printing press. In such arrangement each carriage is provided with its own screw spindle and its own screw spindle drive. This known apparatus requires an expensive control for the motors driving the screw spindles, necessitating an expensive electronic control system.

OBJECT OF THE INVENTION

It is, therefore, an object of the invention to provide an apparatus of the kind indicated in the opening paragraph above, wherein the carriages can be displaced with sufficient accuracy without expensive control devices, so that the apparatus can be used to particularly good advantage in smaller printing presses.

SUMMARY OF THE INVENTION

In accordance with the invention, there is provided an apparatus for the displacement of bearing blocks mounted on shaft supporting carriages, of which a first carriage is carried for displacement in a carriage guideway fixed to the frame, and the other carriage is carried in a carriage guideway of the first carriage, said carriage guideways being mutually parallel, preferably for the displacement of the bearing blocks of plate cylinders and inking rollers, of a printing unit of a multicolour rotary printing press which has two screw spindle drives displacing the carriages and is provided with a motor drive, including:- two spindle screw nuts designed as toothed belt pulleys mounted in the first carriage parallel to each other and for free rotation; the screw spindles of said drives being screwed into the nuts and mounted selectively for free rotation for being fixed against rotation; one of said screw spindles being further mounted in the machine frame and on the other of said screw spindles being further mounted in the second carriage; and a further toothed belt drive pulley in the first carriage drivable by a motor and securable by a securing device, said further toothed belt pulley driving an endless toothed belt that drives the first-mentioned toothed belt pulleys.

If this apparatus is used as a screw spindle drive for the plate cylinder carriages and the inking roller carriages of a flexographic printing press, the carriages can be displaced relative to the machine frame by means of the toothed belt drive if the screw spindles are respectively mounted so as to be secured against rotation on the frame or the inking unit carriage, in such a way that the inking unit carriage moves relative to the frame at twice the speed of the plate cylinder carriage. This means that when the plate cylinders and inking unit rollers have been removed from their common impression cylinder, the plate cylinder can be changed in a simple way. The arrangement is such that the cylinders, when positioned in the printing operation, assume a position relative to each other wherein the plate cylinder is in contact with the impression cylinder and the inking roller is in contact with the plate cylinder. Of course a fine adjustment may still be necessary and can, for example, be effected in that the screw spindles are provided at one end with knobs that are actuable by hand. In this fine adjustment, the screw spindle clamping devices on the frame or on the inking unit carriage must, of course, be released and the spindle screw nuts designed as toothed belt pulleys have to be blocked by means of the toothed belt drive.

The securing devices for the screw spindles and the shaft of the toothed belt drive pulley consist expediently of braking or clamping jaws that are movable by motor means.

In a further development of the invention, provision is made for the hub of the toothed belt drive pulley to be provided with an annular groove extending over a portion of its circumference, into which a securing pin may be inserted and from which it may be extracted. Thus when the pin is inserted, the toothed belt drive pulley is capable of executing a limited rotation of, for example, approximately 250 degrees by being driven by a motor; this is sufficient for the displacement of the cylinders for the "printing-on" and "printing-off" selection operations.

The drive motor for the toothed belt drive pulley consists expediently of a pneumatic motor which readily stalls when the pin projectable into the annular groove abuts against one of the two stops.

Instead of a toothed belt driving the spindle screw nuts, provision may of course be made for a transmission of a different kind, for example a gear wheel system.

BRIEF DESCRIPTION OF THE DRAWINGS

An example of an embodiment of the invention will be explained below in greater detail, merely by way of example, with reference to the accompanying drawings, in which.

DETAILED DESCRIPTION OF THE PREFERRED EMBODIMENT

Figures 1, 2, 3:
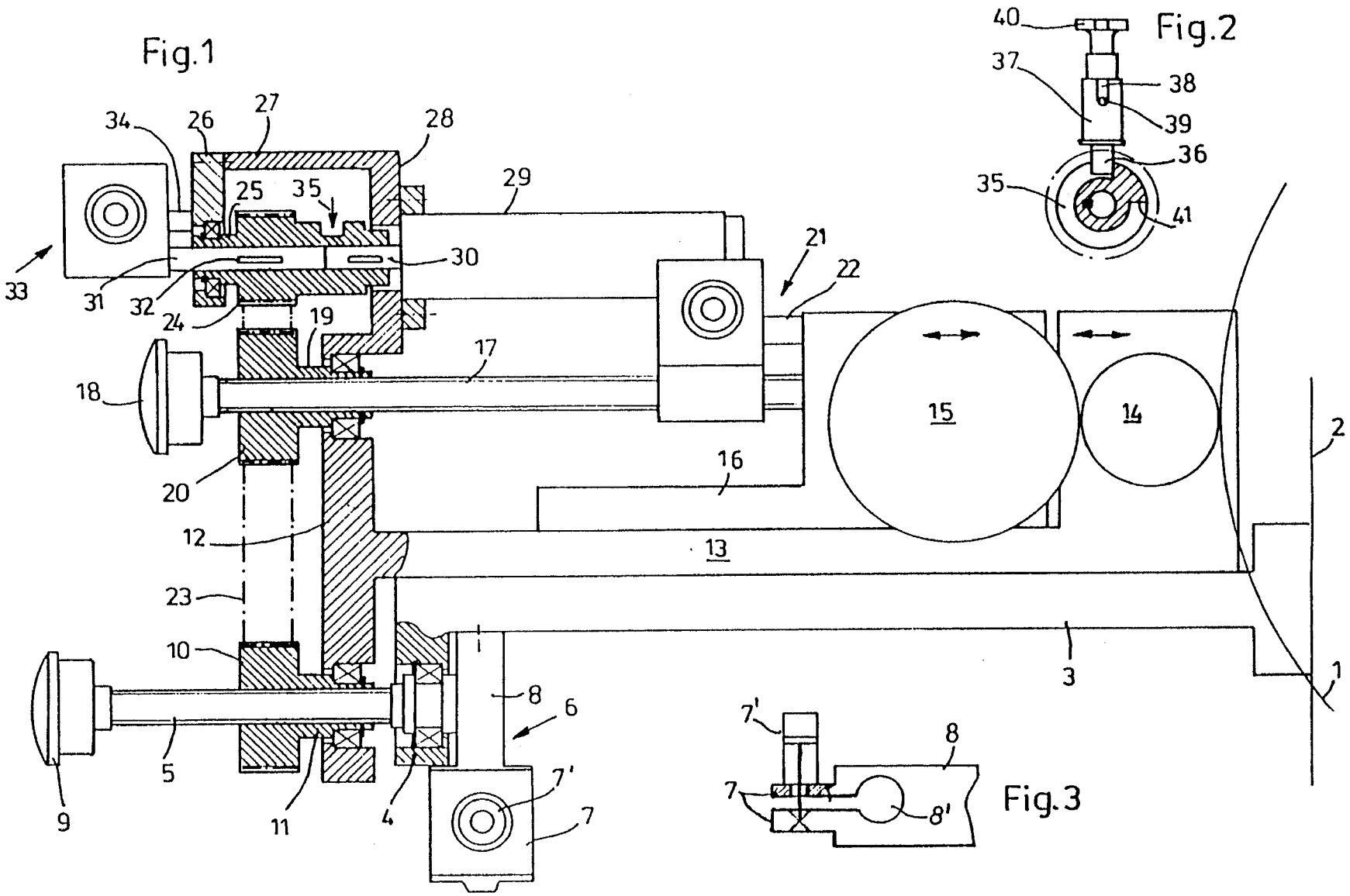
FIG. 1 is a partly sectioned side view of the plate cylinder carriages and inking roller carriages mounted for displacement on a bracket of the frame of a flexographic printing press.
FIG. 2 is a cross-section through the hub of the drive belt pulley.
FIG. 3 is a schematic representation of the clamping device for the screw spindles and the shaft of the toothed belt drive pulley.

FIG. 1 shows the carriage 13 for the plate cylinder 14 mounted for displacement on a bracket 3 of the frame 2 of a flexographic printing press. On this carriage 13, the carriage 16 for the inking roller 15 is in turn mounted for displacement in a carriage guideway. The flexographic printing press, of which the carriage guideways and carriage drives form part, is of a per se known design, as known for example from the DE-A-29 41 521, DE-A-34 37 316, DE-A-37 42 129 and DE-A-40 01 735, the disclosures of which are incorporated herein by reference for a more detailed explanation of the basic design of flexographic printing presses.

The impression cylinder 1 is mounted in the usual way in the printing press frame 2, onto which are screwed the individual brackets 3, one of which is shown in FIG. 1. On its end remote from the frame stand 2, the bracket 3 has a bent extension 4 which is provided with a bore to receive a screw spindle 5 rotatably mounted by means of roller bearings in the way shown. By means of a spindle clamping device shown in FIG. 3, the screw spindle 5 can be secured against rotation if required.

In its simplest design, the clamping device consists, as shown in FIG. 3, of a supporting component 8 joined to the bracket 3 and provided with a bore 8' receiving an untapped end portion of the screw spindle 5. In this arrangement, the bore 8' is provided with an open slot between two jaw-defining extensions 7. These jaw-defining extensions 7 can be moved closer together and be separated by a pneumatic cylinder 7' whose cylinder is connected to one jaw and its piston rod to the other jaw.

The end of the screw spindle 5 remote from the clamping device carries a manual turning knob 9. A toothed belt pulley 10 with an extension 11 is disposed on the screw spindle 5. By means of this extension 11, the toothed belt pulley 10 is mounted rotatably in an end plate 12, and the arrangement is such that the end plate 12 forms part of the plate cylinder carriage 13. This plate cylinder carriage 13 carries the plate cylinder 14 in a manner known per se. In the embodiment shown, the plate cylinder bears on the one hand, on the impression cylinder 1 and, on the other hand, on the inking roller 15. The inking roller 15 is supported on the carriage 16 which is displaceable relative to the plate cylinder carriage 13. A further screw spindle 17 is mounted at one end in the inking roller carriage 16, and carries a manual turning knob 18 on the free end of this screw spindle 17. In the vicinity of this knob 18, a toothed belt pulley 20, provided with an extension 19, is fitted on the screw spindle 17 and has its inner thread meshing with the thread of the screw spindle 17. The toothed belt pulley 20 is mounted rotatably in the end plate 12 via the extension 19. A spindle clamping device 21, similar to the clamping device 6 on spindle 5, is also assigned to the screw spindle 17 and is secured against rotation by means of a holder 22 connected to the inking roller block 16.

FIG. 1 shows, moreover, that a common toothed belt 23 wraps round both toothed belt pulleys 10 and 20 and additionally also wraps round the drive belt pulley 24. This pulley 24 has several recesses, and is rotatably mounted by means of its extension 25 in a removable cover 26 of a frame housing 27 forming part of the end plate 12. A pneumatic motor 29, rigidly joined to the right-hand wall 28 of the housing 27, has its drive shaft 30 connected to the drive belt pulley 24. In the drive pulley 24, there is, moreover, mounted a shaft 31 which is secured against rotation relative to the drive pulley 24 by means of a feather key 32. The end of the shaft 31 projecting from the removable cover 26 co-operates with a further spindle clamping device 33 which is secured against rotation by means of a holder 34 rigidly connected to the cover 26.

The pneumatic motor 29 can, for example, be a compressed air motor type 2 DM5, described on page 52 of the April 1989 catalogue of the firm of Desoutter GmbH of 6457 Maintal 3, Germany.

Although not evident from the drawings, to ensure that the toothed belt 23 wraps round the toothed belt pulleys 10, 20 and 24 with a good grip, the top toothed belt drive pulley 24 is arranged with a lateral offset relative to the toothed belt pulleys 10, 20.

As is clearly evident in FIG. 2, the toothed belt pulley 24 is provided with a groove 35 extending over approximately 250 degrees, and into which there projects a retractible pin 36. This pin is mounted in a tubular component 37 which has a slot 38. A peg 39 rigidly connected to the pin 36 projects radially outwardly into this slot. By means of a handle part 40 joined to one of its ends, the pin 36 can be pulled out of the groove 35 against a resilient force and then be secured in the retracted position by rotation of the handle 40, so that the peg 39 then bears on the upper edge of the tubular component 37.

Now if, for example, the inking unit shown in FIG. 1 is to be moved into the "printing-off" position, the spindle clamping devices 6 and 21 are activated and the spindle clamping device 33 is released. The pneumatic motor 29 is then energised with compressed air, and rotates the toothed belt drive pulley 24 through approximately 250 degrees which is the limited rotational angle permitted by the pin 36 (FIG. 2) bearing against the stop surface 41 at the end of the groove 35 of the toothed belt pulley 24 and thus preventing any further rotation. During this rotational movement, the toothed belt pulleys 10, 20 have of course also been rotated-through the corresponding angle by the toothed belt 23. Since the screw spindles 5 and 17 are secured against rotation, they have moved so far leftwards that on the one hand, the plate cylinder 14, carried by the plate cylinder block 13, has been lifted off to a small extent from the impression cylinder 1 by means of rotation of the screw spindle 5 and, on the other hand, the inking roller 15 has been released to a small extent from the plate cylinder 14 by means of rotation of the screw spindle 17 driving and the plate cylinder block 13. For example, as soon as an adhesively secured join in the web to be printed has passed through the gap between the plate cylinder 14 and the impression cylinder 1 with the cylinder i held-off, the pneumatic motor 29 is operated to rotate the toothed drive belt pulley 24 until the drive belt pulley 24 has reached the position shown in FIG. 2. In this position, the plate cylinder 14 and the inking roller 15 have also reached their printing position.

If a change of the plate cylinder 14 is required, the pin 36 (FIG. 2) is retracted from the groove 35 and secured. Thereupon the pneumatic motor 29 is actuated so that, with the spindle clamping devices 6 and 21 activated to clamp the spindles 5 and 17, the plate cylinder carriage 13 and the inking roller carriage 16 are moved far enough leftwards and for it to be possible, for example, to insert a larger plate cylinder 14 as well. After the plate cylinder 14 has been changed, the pneumatic motor 29 is again operated, in the opposite direction of rotation until the new plate cylinder 14 has come to bear on the impression cylinder 1 and the inking roller 15 to bear on the plate cylinder 14. The pneumatic motor 29 is now switched off.

Since, however, the inking roller 15 and the plate cylinder 14 are still in contact with an indeterminate pressure, a fine adjustment is required. For this purpose, the pin 36 (FIG. 2) is unbolted and moved down to be inserted in the groove 35. Since the position of the toothed drive belt pulley 24 is completely undefined, it is quite uncertain at which point the pin 36 engages in the groove 35 or even whether it is in register with this groove at all. To ensure that the pin 36 does actually become located in the groove 35, the pneumatic motor 29 is run for a short time in the "printing off" rotational direction until one ensures, for example by a visual check, that the pin 36 is actually inserted in the groove 35 and assumes the abutment position shown in FIG. 2. Thereupon the spindle clamping device 33 is activated and the two other clamping devices 6 and 21 are released. Now, firstly, the inking roller 15 is moved towards the plate cylinder 14 by turning the manual knob 18 until proper inking is obtained. Then, the plate cylinder 14 is moved towards the impression cylinder 1 by turning the manual knob 9 until a proper printing quality is achieved. During this adjustment, the position of the inking roller 15 relative to the plate cylinder 1 will not be altered, since the toothed belt pulleys 10 and 20 are both secured against rotation by means of the toothed belt 23, and by means of the activated spindle clamping device 33. After these adjustment operations, the spindle clamping devices 6 and 21 are activated to clamp the spindles 5 and 17, whereby the position of the plate cylinder 14 and of the inking roller 15 are secured. The printing may be started. Now if the "printing-off" position is to be entered, this is done, as has already been described at the outset, by releasing the clamping device 33 and by means of operating the pneumatic motor 29 to rotate the toothed drive belt pulley 24 by approximately 250 degrees.

Reference herein to the "inking rollers" is to be construed broadly to cover any roller applying ink to the surface of a plate on the plate cylinder, and may for example denote the ink distributing oscillating roller of the inking unit.

We claim:

1. In an apparatus for displacement of bearing blocks mounted on shaft supporting carriages in a printing unit comprising: a bracket; a first shaft supporting carriage; a first carriage guideway fixed to said bracket for displacement of said first carriage; a second shaft supporting carriage; a second carriage guideway in said first carriage; said second carriage being carried in said second carriage guideway in said first carriage; said first and second carriage guideways being mutually parallel; first and second screw spindles for displacing said first and second carriages, respectively; and a motor drive for said first and second screw spindles;

the improvement including;

two spindle screw nuts in the form of first and second toothed belt pulleys mounted in said first carriage parallel to one another and mounted for free rotation; said first and second screw spindles being screwed into said first and second toothed pulleys, respectively; means for selectively operating said first and second toothed belt pulleys for free rotation and for being fixed against rotation; said first toothed belt pulley also engaging in said bracket; said second toothed belt pulley also engaging said second carriage; a toothed belt drive pulley in said first carriage; a motor for driving said toothed belt drive pulley; a clamping device for securing said toothed belt drive pulley; an endless toothed belt engaging said first and second toothed belt pulleys as well as said toothed belt drive pulley; said toothed belt drive pulley driving said first and second toothed belt pulleys via said endless toothed belt.

2. An apparatus according to claim 1, wherein said means for fixing said first and second toothed belt pulleys against rotation and said clamping device of said toothed belt drive pulley consist of clamping jaws; and means for moving said clamping jaws.

3. An apparatus according to claim 1, wherein said toothed belt drive pulley includes a hub; said hub including a groove extending over a portion of its circumference; and a securing pin for inserting into and retracting from said groove.

4. An apparatus according to claim 1, including first and second manually actuable control knobs each mounted at an end of a respective one of said first and second toothed belt pulleys.

5. An apparatus according to claim 1, wherein a plate cylinder of a flexographic printing press is mounted on said first carriage; and an inking unit including at least one inking unit roller having a doctor blade of an ink fountain is mounted on said second carriage.

* * * * *